US008926486B2

(12) United States Patent
Diehr et al.

(10) Patent No.: US 8,926,486 B2
(45) Date of Patent: Jan. 6, 2015

(54) TOOL HOLDING DEVICE AND SHEET-PROCESSING MACHINE AND FOLDING CARTON GLUER HAVING THE DEVICE

(75) Inventors: Wolfgang Diehr, Grevenbroich (DE); Martin Mertens, Schriesheim (DE); Frank Schmid, Krefeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 706 days.

(21) Appl. No.: 13/213,194

(22) Filed: Aug. 19, 2011

(65) Prior Publication Data

US 2012/0053034 A1 Mar. 1, 2012

(30) Foreign Application Priority Data

Aug. 31, 2010 (DE) ..... 10 2010 036 014

(51) Int. Cl.

| | |
|---|---|
| ***B31B 1/62*** | (2006.01) |
| ***B31B 1/26*** | (2006.01) |
| ***B31B 1/74*** | (2006.01) |
| ***B31B 1/00*** | (2006.01) |
| ***B44B 5/00*** | (2006.01) |

(52) U.S. Cl.

CPC ... *B31B 1/00* (2013.01); *B44B 5/00* (2013.01); *B31B 2201/0247* (2013.01); *B31B 2203/066* (2013.01)

USPC ..... 493/468; 493/471; 493/475; 493/478

(58) Field of Classification Search

USPC ..... 493/468, 471, 473, 475, 476, 478

See application file for complete search history.

(56) References Cited

U.S. PATENT DOCUMENTS

| | | | | |
|---|---|---|---|---|
| 2,239,454 | A | 4/1941 | Carlson | |
| 4,405,304 | A * | 9/1983 | Bensberg et al. | 493/476 |
| 5,178,069 | A | 1/1993 | Rodi | |
| 5,906,569 | A * | 5/1999 | Ratzel | 493/363 |
| 6,095,963 | A * | 8/2000 | Shaw | 493/379 |
| 6,419,079 | B1 | 7/2002 | Diehr | |
| 6,550,219 | B2 * | 4/2003 | Liao | 53/374.6 |
| 6,565,499 | B2 | 5/2003 | Benzoni | |
| 6,729,217 | B2 * | 5/2004 | Loewensberg | 83/332 |
| 7,060,016 | B2 * | 6/2006 | Cipolli | 493/478 |
| 7,402,129 | B2 | 7/2008 | Diehr | |
| 7,670,274 | B2 | 3/2010 | Diehr et al. | |
| 7,678,035 | B2 | 3/2010 | Jansen | |
| 7,794,379 | B2 | 9/2010 | Diehr et al. | |
| 2004/0256058 | A1 * | 12/2004 | Irwin et al. | 156/580 |

(Continued)

FOREIGN PATENT DOCUMENTS

| | | | |
|---|---|---|---|
| DE | 4421011 | A1 | 1/1996 |
| DE | 198 28 819 | A1 | 12/1999 |

(Continued)

*Primary Examiner* — Hemant M Desai

(74) *Attorney, Agent, or Firm* — Laurence A. Greenberg; Werner H. Stemer; Ralph E. Locher

(57) ABSTRACT

A device for holding tools for processing flat, sheet-like material includes top and bottom tool holding devices which have respective top and bottom tool units that are driven by drive shafts through servomotors and are laterally displaceable by tool guide elements which are supported on cross members. The top and bottom cross members have a rectangular construction and are fitted perpendicularly in the device. A sheet-processing machine and a folding carton gluer having the device, are also provided.

26 Claims, 11 Drawing Sheets

(56) References Cited

U.S. PATENT DOCUMENTS

| | | | | |
|---|---|---|---|---|
| 2009/0178528 | A1 | 7/2009 | Adami | |
| 2009/0227437 | A1* | 9/2009 | Diehr et al. | 493/468 |
| 2010/0229738 | A1 | 9/2010 | Hirota et al. | |
| 2010/0248924 | A1 | 9/2010 | Diehr et al. | |
| 2012/0048131 | A1* | 3/2012 | Diehr et al. | 101/3.1 |
| 2013/0045847 | A1* | 2/2013 | Capoia | 493/59 |

FOREIGN PATENT DOCUMENTS

| | | | |
|---|---|---|---|
| DE | 10 2004 022 344 | A1 | 12/2005 |
| DE | 20 2008 003 135 | U1 | 4/2008 |
| EP | 0417465 | A2 | 3/1991 |
| EP | 1120209 | A2 | 8/2001 |
| EP | 1 591 230 | A1 | 11/2005 |
| EP | 1647378 | A1 | 4/2006 |
| EP | 1857235 | A1 | 11/2007 |
| EP | 1 920 911 | A1 | 5/2008 |
| EP | 1920910 | A1 | 5/2008 |
| EP | 1990183 | A2 | 11/2008 |
| EP | 2008802 | A1 | 12/2008 |
| EP | 2070721 | A2 | 6/2009 |
| FR | 1416191 | A | 10/1965 |

* cited by examiner

TOOL HOLDING DEVICE AND SHEET-PROCESSING MACHINE AND FOLDING CARTON GLUER HAVING THE DEVICE

CROSS-REFERENCE TO RELATED APPLICATION

This application claims the priority, under 35 U.S.C. §119, of German Patent Application DE 10 2010 036 014.7, filed Aug. 31, 2010; the prior application is herewith incorporated by reference in its entirety.

BACKGROUND OF THE INVENTION

Field of the Invention

The invention relates to a device for holding tools for processing flat, sheet-like material in a sheet-processing machine, in particular folding carton gluers, folding machines or cover feeders. The device includes a right-hand frame wall and a left-hand frame wall which are connected to one another by cross members, a bottom tool holding device for a bottom tool unit and a top tool holding device for a top tool unit. The tool holding devices each have right-hand and left-hand side walls, respective top and bottom cross members and respective top and bottom drive shafts. The bottom cross member is fastened to the frame walls and the bottom drive shaft is fastened in the side walls of the bottom tool holding device. The top cross member and the top drive shaft are fastened in the side walls of the top tool holding device. The invention also relates to a sheet-processing machine and a folding carton gluer having the device.

Both printing machines with integrated postpress apparatuses, for example for creasing or embossing, and postpress machines such as, for example, folding machines, cover feeders or folding carton gluers, have tool units for processing the sheet-like material.

Additionally, during the production of high-grade printed products for the packaging industry, for example folding cartons, first of all sheets are printed in short grain in a printing machine. A plurality of copies of the folding cartons to be produced are in each case printed onto the sheets and are then blanked in a blanking press. The blanked-out folding carton blanks are then fed to a folding carton gluer and processed there to form folding cartons.

As is well known, folding carton gluers for producing folding cartons from folding carton blanks have at least the following modules as processing stations:

a feeder which draws off the blanks to be processed from a stack one after the other at high speed and feeds them individually to a following first processing station, an application mechanism for adhesive, normally glue, which applies an adhesive strip to the folding tabs to be adhesively bonded, a folding station in which the blank parts provided with an adhesive strip are turned over by 180°, that is to say they are folded, for producing an adhesive connection, a "transfer station" is normally provided following the folding station, in which transfer station the cartons can be counted, marked and, if defective, expelled, and that is followed by a compression station, at the start of which an imbricated flow of folded blanks is formed, which is held under pressure for some time in the compression station so that the two blanks are connected at the gluing seam.

In addition, folding carton gluers optionally have modules for creasing, die cutting and embossing, for example for embossing Braille in pharmaceutical packaging.

The individual processing stations have driven conveying devices for transporting the folding carton blanks. The conveying devices are formed, for example, in each case of a top and a bottom conveying belt disposed on the side of the machine, with the bottom conveying belt being guided in a roller cheek and the top conveying belt being guided in a roller bar. The conveying belts are disposed in a transversely adjustable manner and can therefore be set to the respective folding carton blank format. The blanks are transported between the top and the bottom conveying belt with the printed side downward.

Such a folding carton gluer is known, for example, from German Published Patent Application DE 10 2004 022 344 A1, corresponding to European Patent Application EP 1 593 485 A1.

Furthermore, a folding carton gluer having a module for embossing Braille is known from European Patent Application EP 1 920 911 A1, corresponding to U.S. Pat. No. 7,794, 379 and U.S. Patent Application Publication No. US 2010/ 0248924 A1.

In the known modules, adaptation of the tool to the sheet format to be processed in each case or the changing of tools is very complicated.

SUMMARY OF THE INVENTION

It is accordingly an object of the invention to provide a tool holding device and a sheet-processing machine and a folding carton gluer having the device, which overcome the hereinafore-mentioned disadvantages of the heretofore-known devices of this general type and in which tool units can be adapted in a simple manner to a respective sheet format and to processing to be carried out in each case, or can be changed in a simple manner.

With the foregoing and other objects in view there is provided, in accordance with the invention, a device for holding tools for processing flat, sheet-like material in a machine processing sheets, in particular folding carton gluers, folding machines or cover feeders. The tool holding device includes a right-hand wall and a left-hand wall which are connected to one another by cross members. Furthermore, the device has a bottom tool holding device for a bottom tool unit and a top tool holding device for a top tool unit. The tool holding devices each have right-hand and left-hand side walls, respective top and bottom cross members and respective top and bottom drive shafts. The bottom cross member is fastened to the frame walls and the bottom drive shaft is fastened in the side walls of the bottom tool holding device. The top cross member and the top drive shaft are fastened in the side walls of the top tool holding device.

According to one embodiment of the invention, the cross members have a profile which is suitable for absorbing the forces produced during the processing of the blank, for example during the embossing, transversely to, in and perpendicularly to the blank running direction. The forces absorbed by the cross members are in this case advantageously dissipated through the frame walls and side walls. As a result, it is possible for the drive shafts to be dimensioned to be smaller in their diameter and thus for the moving masses to be kept small. The top and bottom tool units can be adjusted laterally in a sliding manner on the cross members by top and bottom tool guide elements. As a result, it is advantageously possible to locate the tool at any desired position of the sheet and/or to position any desired number of tools on the drive shaft. Furthermore, forces that occur, for example embossing forces, are absorbed in the cross member. The drive shaft therefore has a relatively thin construction, since it only has to transmit the drive forces. In addition, this embodiment offers the advantage that tools of different widths can be used in a simple manner.

According to another, especially preferred embodiment of the invention, the top tool holding device can be pivoted about the bottom tool holding device around an axis of rotation or shaft being fixed relative to the frame. As a result, firstly a tool change is simplified and secondly a removal of faults, for example during a double infeed of sheets, is simplified.

In accordance with another feature of the invention, the top and bottom tool units are fixed at any desired point on the cross members by pneumatic clamping elements. In this way, the tool units can be fixed simply and quickly. As an alternative, fixing by a mating pin and a mating groove/hole is, of course, also possible.

In accordance with a further feature of the invention, the tool units have a top and a bottom tool, respectively, which are fastened to a respective universal holding cylinder. Different processing tools can thus be advantageously interchanged simply and quickly.

In accordance with an added feature of the invention, the bottom side walls are fastened to the frame walls, with the bottom side wall on the operator side being constructed as a removable bearing cap for the bottom drive shaft. In addition, the top side wall on the operator side also has a removable bearing cap for the top drive shaft.

This embodiment has the advantage that the lateral plates with bearing configurations can be removed in a simple manner. Due to the shaft ends which are then free, the removal and the insertion of the tool holders are then possible without great effort, which results in short setting-up times, in particular if a change of tool type (for example a tool for creasing, die cutting, embossing, cutting, perforating, milling, applying hot foil, etc.) has to be carried out. Furthermore, the tool units can also be fitted with tools outside the machine and can then be used, in particular, if a plurality of tool pairs are available.

In accordance with an additional feature of the invention, the top and bottom drive shafts are constructed as polygonal shafts. This embodiment offers the advantage of especially easy handling during the tool change. Furthermore, the shape of the drive shafts ensures that the top tool and the bottom tool always rotate at an exact angle relative to one another.

In order to ensure that the top tool is also oriented rotationally relative to the bottom tool, it is, for example, expedient to fix the tools on the polygonal shaft through the use of headless screws.

In accordance with yet another feature of the invention, the top and bottom drive shafts are driven by servomotors.

In accordance with yet a further feature of the invention, the top and bottom tool guide elements have stop regions for the pneumatic clamping elements. This permits easy, simple and accurate positioning and fixing of the tool units.

In accordance with yet an added feature of the invention, the top and bottom tool units interact with a centering element. This can ensure, in a simple manner, that the tool units are displaced and oriented synchronously.

In accordance with yet an additional feature of the invention, the distance between the top and bottom tool units can be varied by two pneumatic cylinders. This permits, in a simple manner, the use of variable thicknesses of the sheet material and furthermore the possibility of variable embossing depths. In addition, the tool units can thus be scaled not only with regard to the working widths but also with regard to the tool diameter. Furthermore, the distance can be set by a fine setting device, in such a way that the embossing depths can be set in an especially accurate manner.

In accordance with again another feature of the invention, the tool units are protected against unauthorized contact by protective boxes and the drive shafts are protected against unauthorized contact by safety configurations. As a result of this encapsulation, the device is protected in a simple manner.

With the objects of the invention in view, there is furthermore provided a sheet-processing machine, comprising a device according to the invention, in which the sheet-processing machine is a printing machine or a postpress machine.

With the objects of the invention in view, there is concomitantly provided a folding carton gluer, comprising a device according to the invention.

Other features which are considered as characteristic for the invention are set forth in the appended claims.

Although the invention is illustrated and described herein as embodied in a tool holding device and a sheet-processing machine and a folding carton gluer having the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
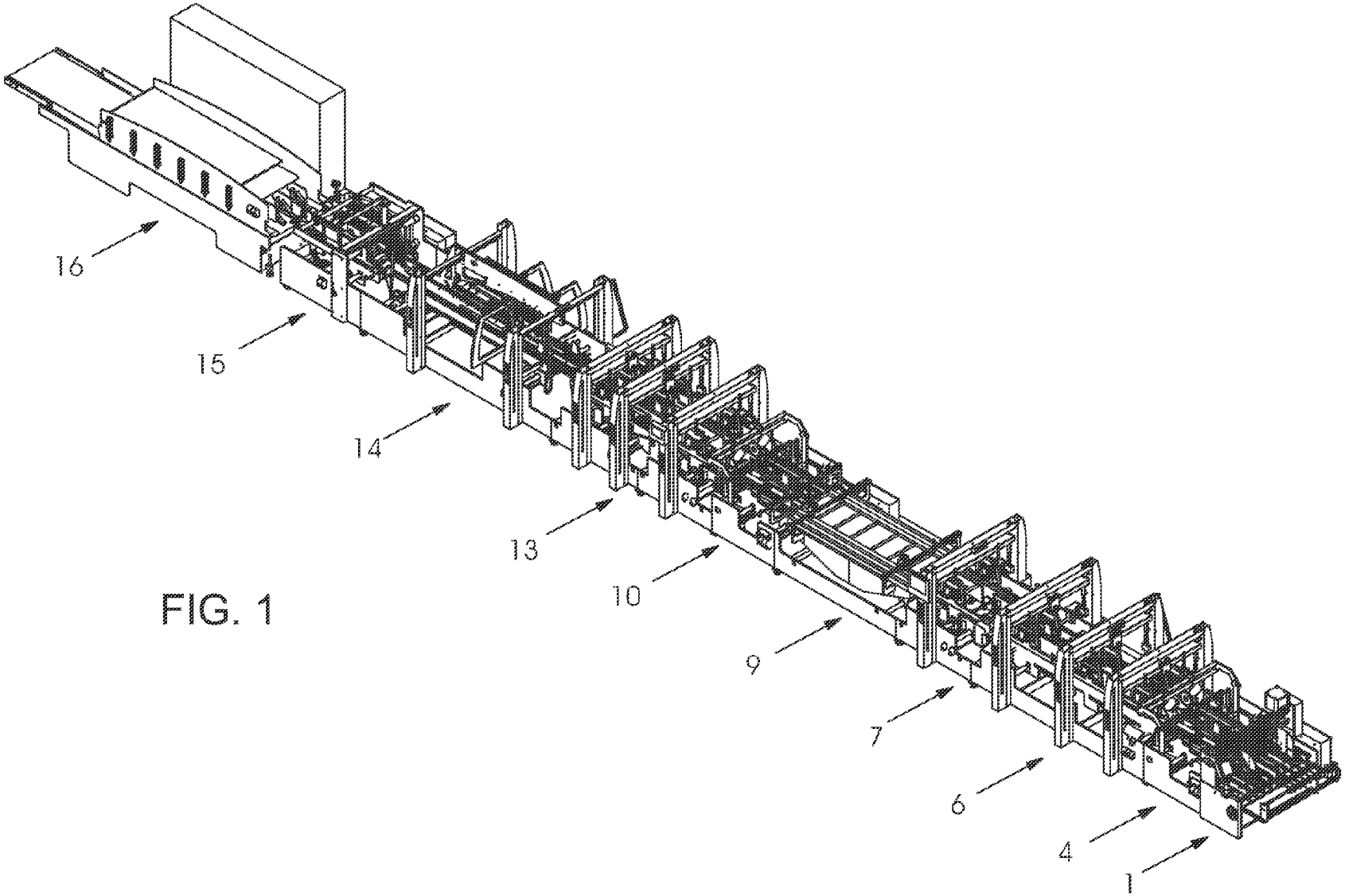
FIG. 1 is a diagrammatic, perspective view showing an example of individual processing stations of a folding carton gluer.

Referring now to the figures of the drawings in detail and first, particularly, to FIG. 1 thereof, there is seen, by way of example for a postpress machine, a folding carton gluer having a plurality of processing stations in which tool holding devices according to the invention can be used.

The folding carton gluer starts, in FIG. 1 at the bottom right, with a feeder 1 which draws off the blanks to be processed at high speed one after the other from a stack and feeds them individually to a following processing station. Following the feeder 1 is an orienting station 4 in which the blanks are oriented against a lateral stop. Leading through the orienting station are machine components, which can be positioned transversely, in the form of two belt pairs which serve as conveying devices and can be positioned transversely by actuators.

This is followed by a prefolder 6 and a first folding module 7. Machine components, which can be positioned transversely, in the form of belt pairs as conveying devices which are positioned transversely by an actuator according to the type of blank, lead through both the prefolder 6 and the folding module 7.

A turning station 9 follows the folding module 7. In order to turn the blanks by 90° about a perpendicular axis, the turning station 9 contains two conveying sections which are disposed in parallel next to one another and the speed of which can be set separately. The blanks rest on both conveying sections, in such a way that they are turned when the two conveying sections are at different speeds. The two conveying sections contain driven rollers as conveying devices.

Following the turning station 9 is a further orienting station 10, which corresponds in its construction to the orienting station downstream of the feeder 1. It therefore contains in turn machine components, which can be positioned transversely, in the form of conveying belt pairs as conveying devices.

The next processing station 13 serves to carry out processing operations according to the type of carton. For example, further crease lines are prefolded or special folds are carried out. Belt pairs as conveying elements which can be positioned transversely by actuators also lead through the processing station 13.

This is followed by a folding station 14 in which blanks provided beforehand with a gluing seam are folded over by 180°. The folding station 14 contains belt pairs as conveying elements and an adhesive application mechanism which can be moved through the use of actuators into their transverse position dependent on the type of blank. This is followed by a transfer station 15, from which the folded blanks provided with gluing seams that have not yet set are fed, exactly oriented in all parts, to a downstream collecting and compression apparatus 16. In the collecting and compression apparatus 16, first of all an imbricated flow of folded blanks is formed, which is then held under pressure for some time between conveying compression belts, so that the gluing seams set. The transfer station likewise contains belt pairs which can be set transversely through the use of actuators.

Figure 2:
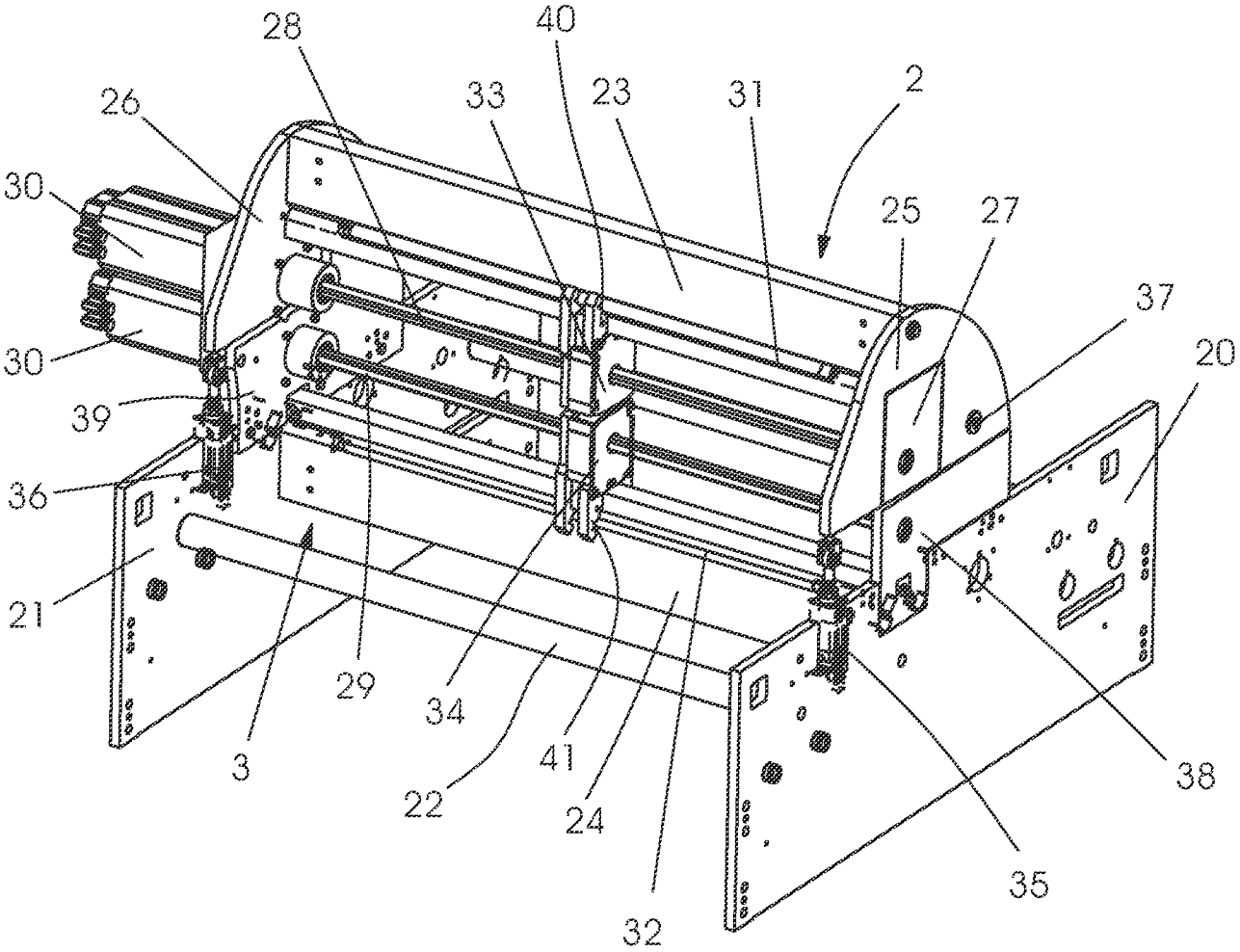
FIG. 2 is a perspective view of a device according to the invention.

FIG. 2 shows a device according to the invention. The device has a right-hand frame wall 20 and a left-hand frame wall 21, which are connected to one another by cross members 22, one of which is shown in FIG. 2. A bottom tool holding device 3 is fixedly screwed to the frame walls 20, 21. The bottom tool holding device 3 has a bottom cross member 24 which is screwed between the frame walls 20, 21. Furthermore, a bottom drive shaft 29 is provided, which is mounted between a left-hand bottom side wall 39 and a right-hand bottom side wall, which is constructed as a bearing cap 38. The left-hand bottom side wall 39 is fastened to the left-hand frame wall 21 and the bottom bearing cap 38 is fastened to the right-hand frame wall 20. A bottom tool unit 34 is mounted on the bottom drive shaft 29 and is laterally connected in a sliding manner to the bottom drive shaft 29 through a bottom tool guide element 41, which is supported on the bottom cross member 24. The bottom tool unit 34 can be fixed at any desired point between the two bottom side walls 38, 39 through the use of a pneumatic bottom clamping element 32. To this end, the pneumatic bottom clamping element 32 presses against a bottom stop region 43 (FIG. 3) of the bottom tool unit 34 and is at the same time supported on the bottom cross member 24.

A top tool holding device 2 is fastened above the bottom tool holding device 3. The top tool holding device 2 is pivotably fastened about a pivot, axis of rotation or shaft 37 fixed relative to the frame. The top tool holding device 2 has a top cross member 23 and a top drive shaft 28, both of which are mounted or fastened between a left-hand top side wall 26 and a right-hand top side wall 25. The right-hand top side wall has a removable top bearing cap 27 for mounting the drive shaft 28. A top tool unit 33 is mounted on the top drive shaft 28 and is laterally connected in a sliding manner to the top drive shaft 28 by a top tool guide element 40, which is supported on the top cross member 23.

According to the invention, the cross members 23, 24 have a profile (that is a form, outline, shape or contour) which is suitable for absorbing the forces produced during the processing of the blank, for example during the embossing, transversely to, in and perpendicularly to the blank running direction. The profile preferably has at least one high moment of resistance perpendicular to the blank running direction. This advantageously ensures that the cross members are virtually parallel to one another over the entire width. The forces absorbed by the cross members are advantageously dissipated in this case through the frame walls and side walls. As a result, it is possible for the drive shafts 28, 29 to be dimensioned to be smaller in their diameter and thus for the moving masses to be kept small. The top tool unit 33 can be fixed at any desired point between the two top side walls 25, 26 through the use of a top pneumatic clamping element 31. To this end, the pneumatic top clamping element 31 presses against a top stop region 42 of the top tool unit 33 (FIG. 3) and is at the same time supported on the bottom cross member 23. The two drive shafts 28, 29 are each driven by a separate servomotor 30. As a result of this construction, the cross members 23, 24 absorb the high forces which possibly occur, for example the embossing forces during the embossing operation, and the drive shafts 28, 29 transmit only the torques. As a result, the rotating masses are kept small. The pivoting movement of the top tool holding device 2 about the fixed pivot 37 is advantageous for removing double infeeds and during a tool change. The distance between the two tool holding devices 2, 3 can be varied by two pneumatic cylinders 35, 36. The latter are supported on the frame walls 20, 21 on the one side and on the top side walls 25, 26 on the other side. The effect of the tool units 33, 34 on the sheet-like material 11, 12 to be processed, which is transported through between the two tool units 33, 34, can thus be set in a specific manner. In particular, resetting to different material thicknesses is thereby possible in a simple manner.

Figure 3A:
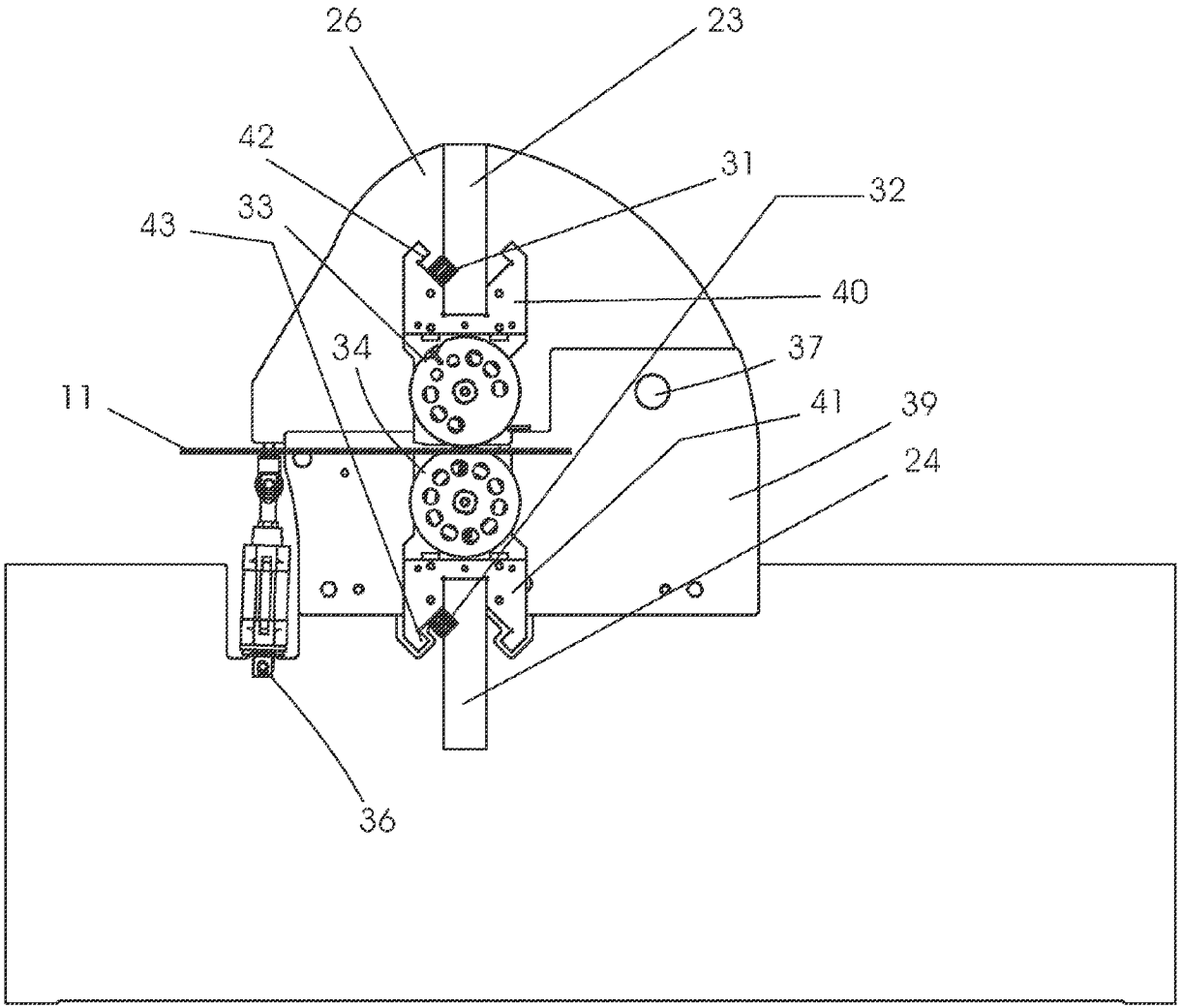
FIG. 3A is a side-elevational view of the device according to the invention.

FIG. 3A shows the device according to the invention in a side view. The left-hand part of the device with the cross members 23, 24, the tool guide elements 40, 41 supported thereon and the tool units 33, 34 is shown. The clamping elements 31, 32, which were already described, with the stop regions 42, 43, can also be seen.

Figure 3B:
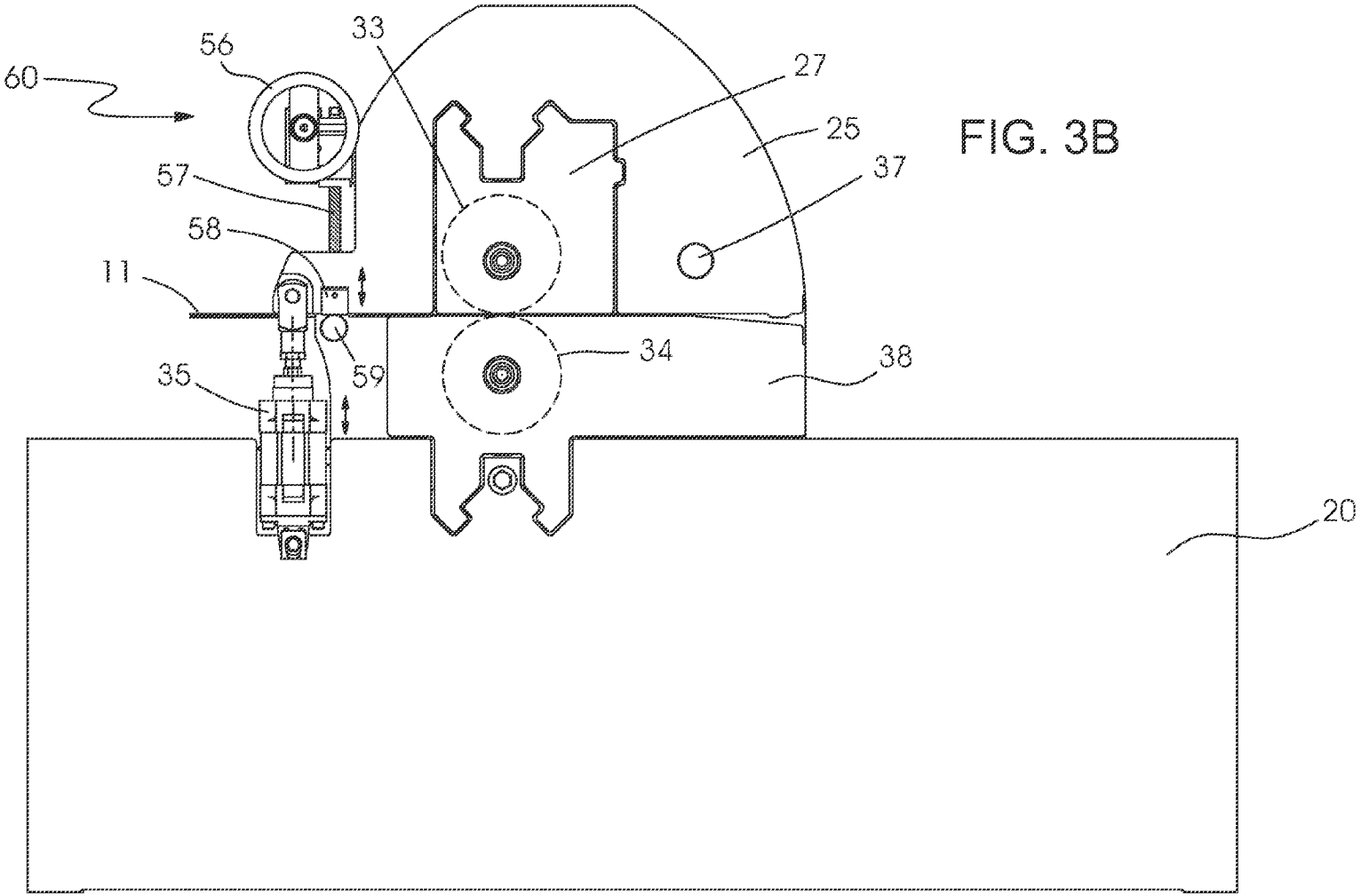
FIG. 3B is a side-elevational view of the device according to the invention with a fine setting device.

The device according to the invention is shown in FIG. 3B in a side view from the opposite side with a fine setting device 60. As already described, the distance between the two tool holding devices 2, 3 and thus also the distance between the tool units 33, 34 can be set by the pneumatic cylinders 35, 36 by pivoting the top tool holding device 2 about the fixed pivot 37. In particular, during the use of embossing tools, for example for embossing Braille symbols in folding cartons, it is advantageous if an additional fine setting of the distance between the embossing tools is possible. As a result, it is firstly possible to set the embossing tools more accurately to the carton thickness, but it is also possible to positively influence the embossing depth in the carton and thus the neat formation of the Braille symbols. A setting possibility to within a hundredth of a millimeter is desirable in this case. In the present invention, this fine setting is realized by the fine setting device 60 having two stops 58, 59. The stop 59 is fixed and the stop 58 is adjustable to the desired distance by a hand wheel 56, a screw spindle 57 and a non-illustrated worm gear unit.

Figure 4:
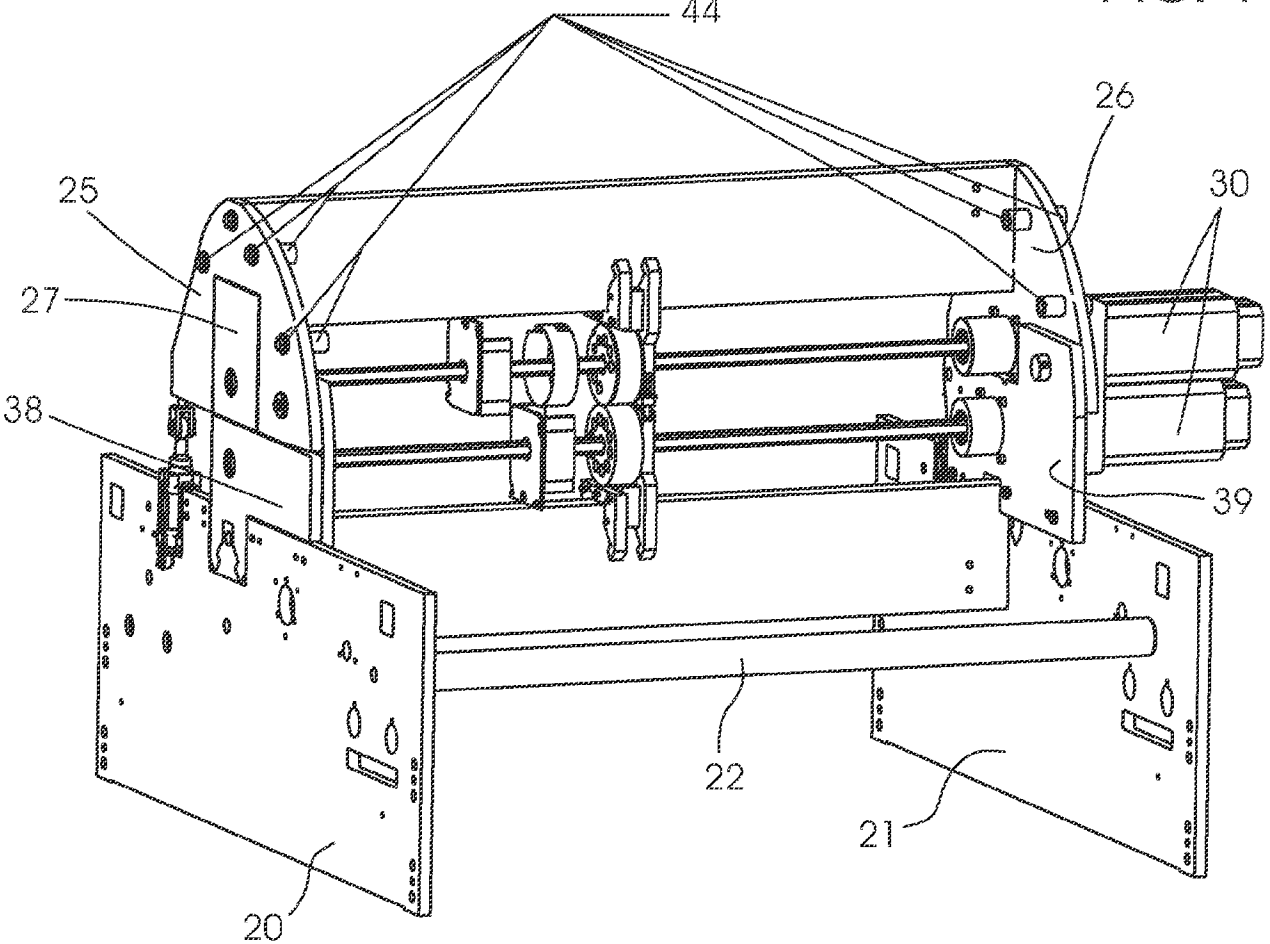
FIG. 4 is a perspective view of a device according to the invention with a safety configuration and partly dismantled tool units.

A safety configuration can be seen in FIG. 4. The safety configuration is formed of a non-illustrated protective plate and light barriers 44 which form a safety light grille. In this way, the tool units are protected against unauthorized contact. Furthermore, the tool units 33, 34 are shown in a partly dismantled state, which is described in more detail with reference to FIG. 6.

Figure 5:
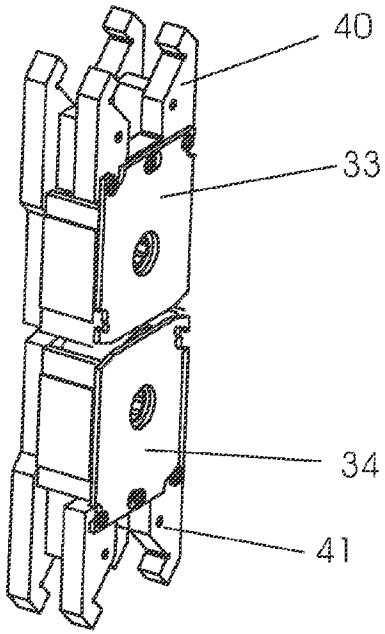
FIG. 5 is a perspective view of tool units according to the invention.

FIG. 5 shows the tool units 33, 34 according to the invention in a removed state together with the tool guide elements 40, 41.

Figure 6:
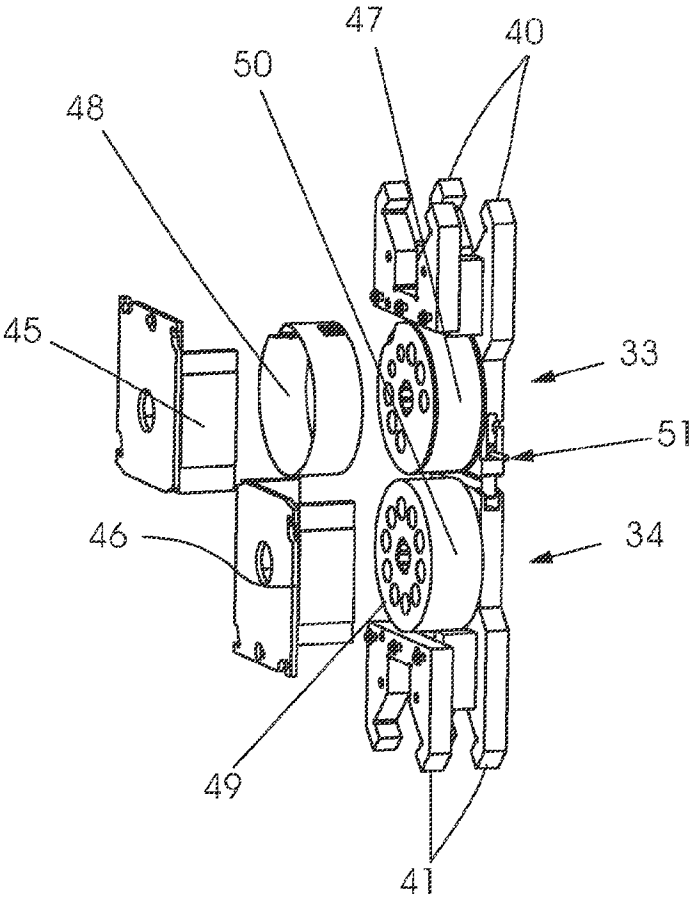
FIG. 6 is a perspective view of tool units according to the invention in a partly dismantled state.

FIG. 6 shows the tool units 33, 34 according to the invention in the removed state and partly dismantled. The top tool unit 33 has a universal holding cylinder 47 on which a top tool 48 is fastened. The top tool unit 33 is protected by a top protective box 45.

The bottom tool unit 34 likewise has a universal holding cylinder 49 with a bottom tool fastened thereon. The bottom tool unit 34 is protected by a protective box 46.

Figure 10B:
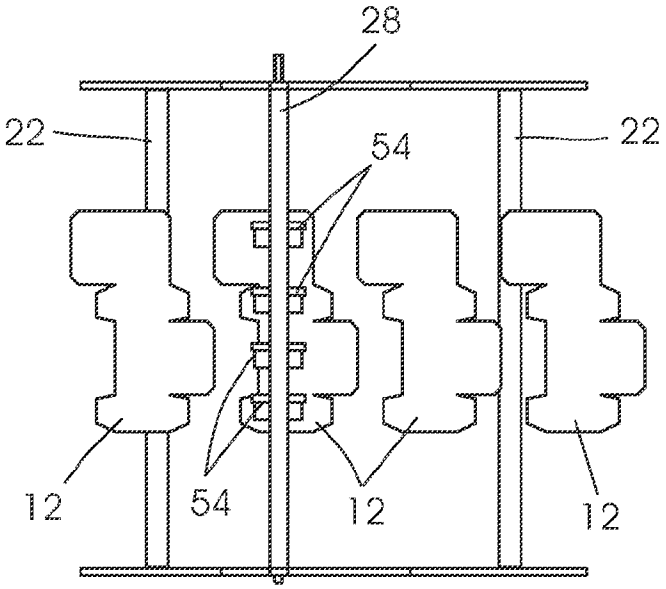
FIGS. 10A and 10B are perspective and plan views showing a device according to the invention with embossing tools.
Figure 10A:
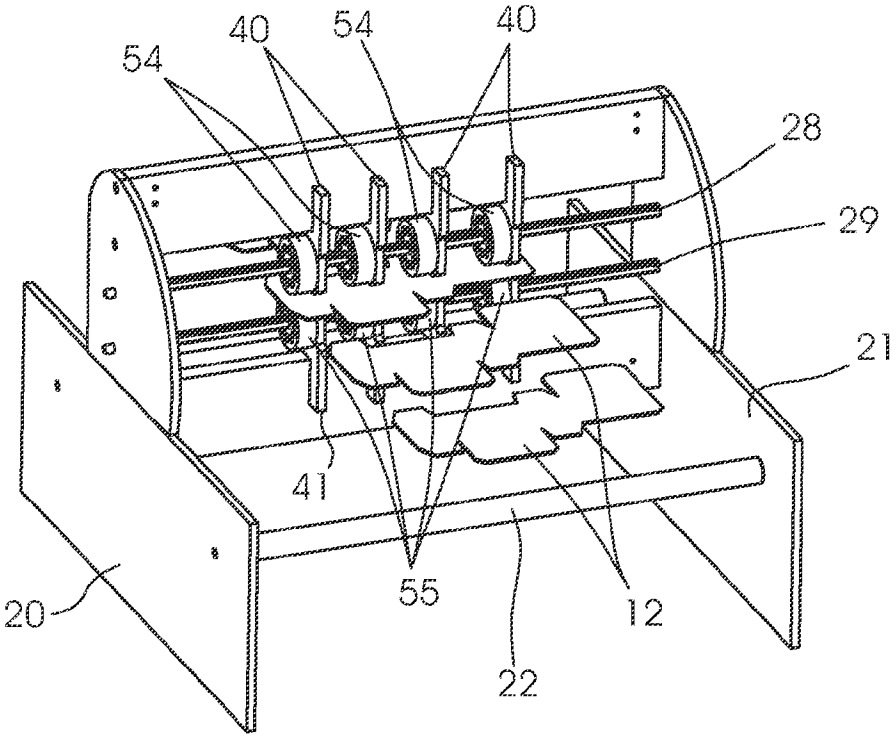

If a plurality of tool units 33, 34 are disposed in each case on the drive shafts 28, 29, for example a plurality of embossing tools 54, 55 for embossing Braille symbols, as shown in FIG. 10A, it can be advantageous that the tools, both with regard to the top tool relative to the bottom tool and the tool pairs relative to one another, can be oriented relative to one another on the shafts in the peripheral direction. This is possible, for example, due to the fact that the tools 48, 50 can be fastened on the universal holding cylinders 47, 49 in an adjustable manner in the peripheral direction, or that the tool units themselves are fastened rotationally relative to clamping elements.

Figure 7:
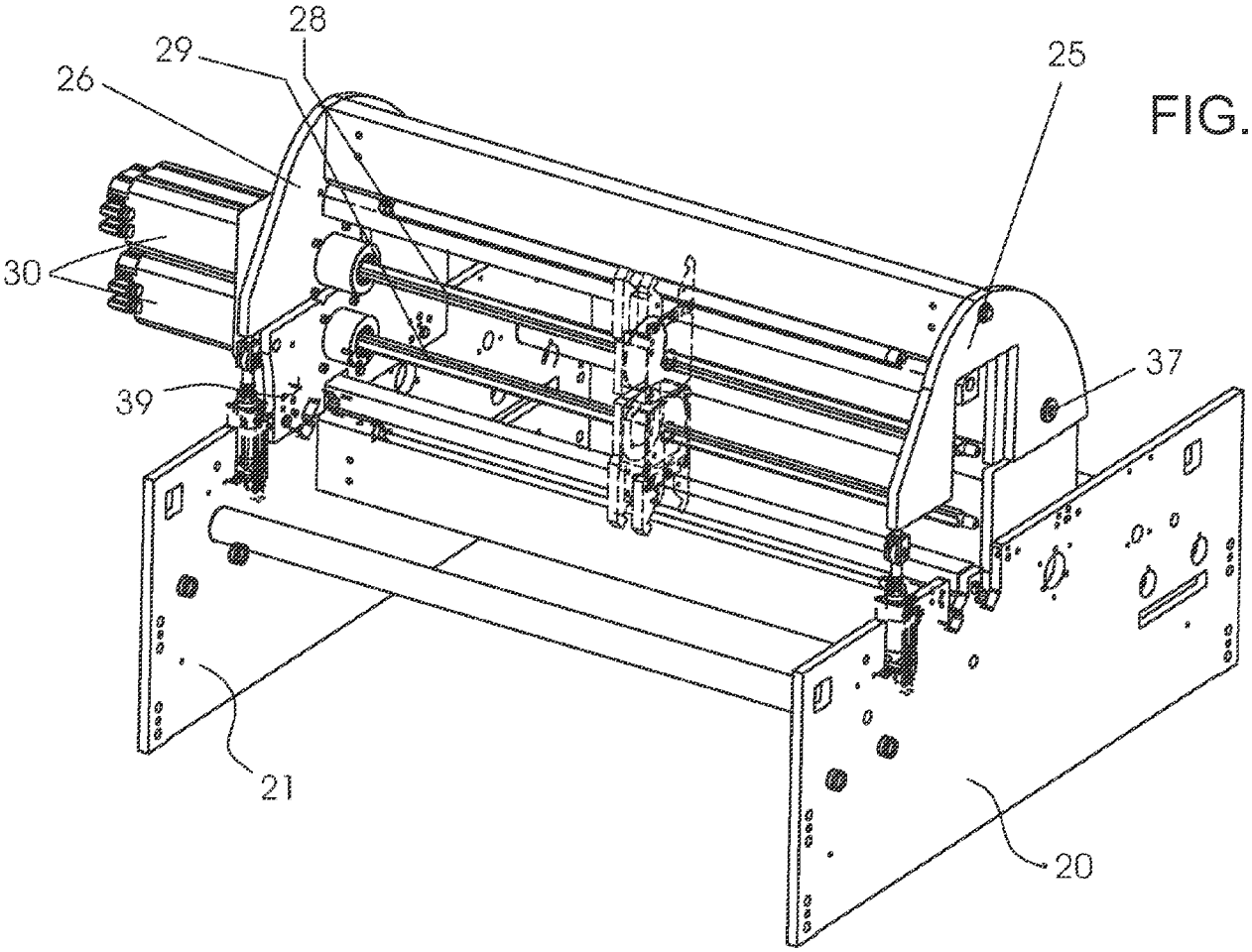
FIG. 7 is a perspective view of a device according to the invention without tool units and without bearing caps.

FIG. 7 shows the device according to the invention with the tool units 33, 34 removed and with the top bearing cap 27 and bottom bearing cap 38 removed. In this state, the drive shafts 28, 29 are freely accessible and the tool units 33, 34 can easily be exchanged.

Figure 8A:
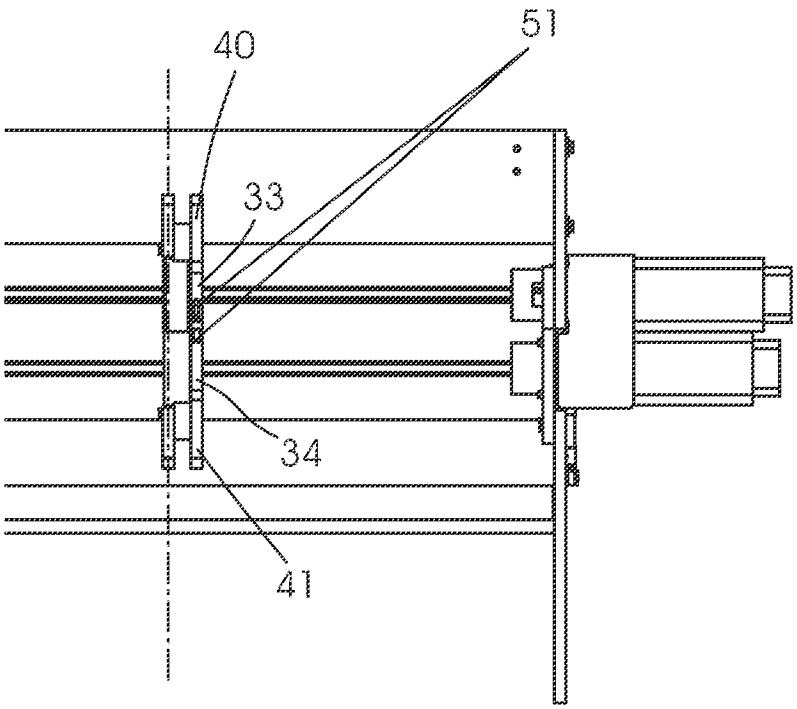
FIG. 8A is an enlarged, fragmentary, front-elevational view showing tool units according to the invention with a centering device.

FIG. 8A shows the tool units 33, 34 with a centering element 51. In order to ensure synchronous displacement/orientation of the two tool units 33, 34, the tool units are coupled to one another through the use of the centering element 51. The centering element is constructed in such a way that a centering function can be switched on and off, depending on whether sheets run through the machine or not. The centering element 51 is a centering pin which is mounted in the top tool unit 33 and which is lowered manually downward into a hole in the bottom tool unit 34 and thus fixedly connects the top tool and the bottom tool to one another (FIG. 6).

Figure 8B:
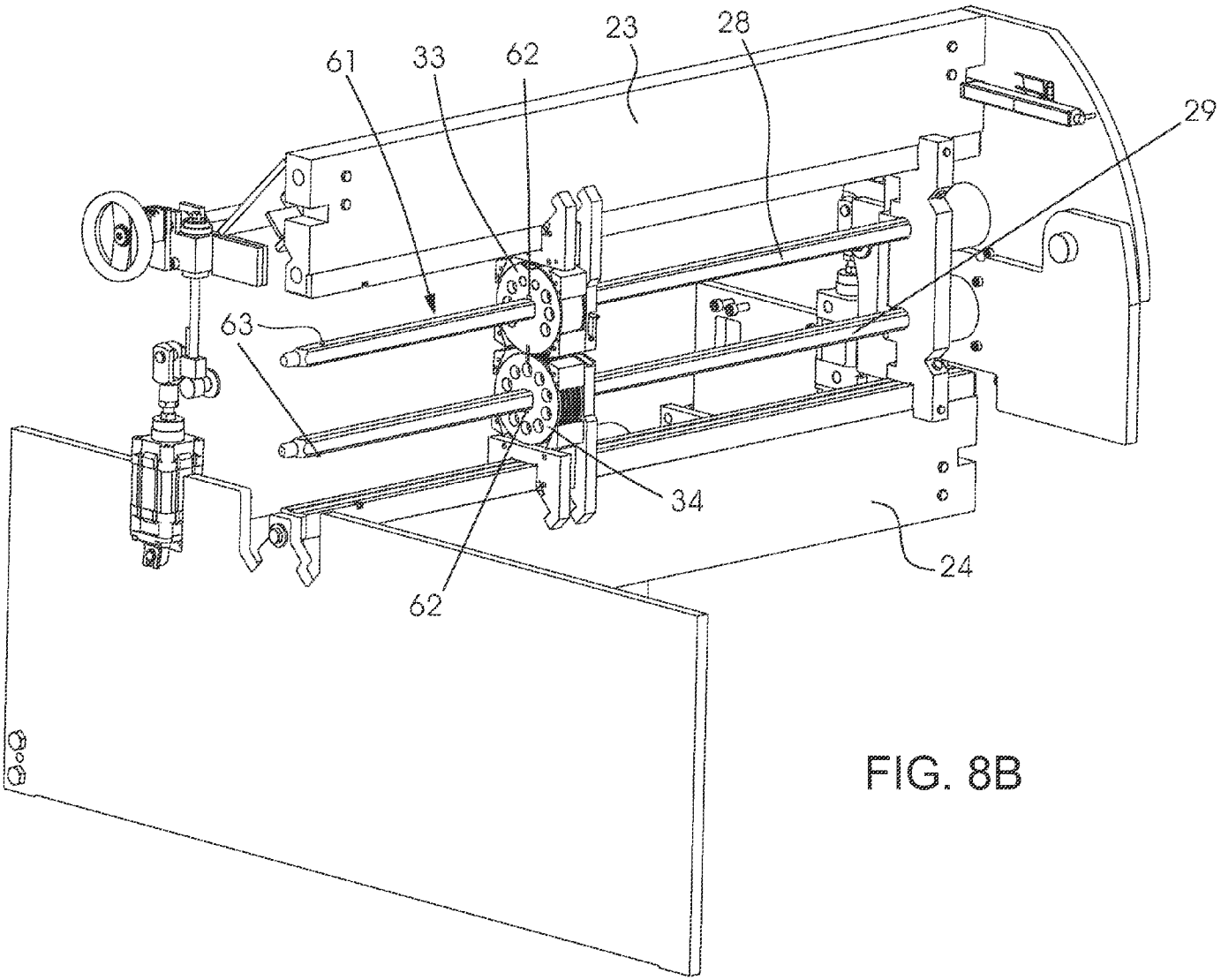
FIG. 8B is a perspective view of a device according to the invention with an indexing device for the tool units.

FIG. 8B shows a device according to the invention with an indexing device 61 for the tool units 33, 34. As already described, the tool units 33, 34 are mounted on the drive shafts 28, 29. These drive shafts 28, 29 can be advantageously constructed as polygonal shafts, for example with a polygon type which, with regard to its cross section, is close to a square. If, for example, the tool units 33, 34 are constructed as embossing tools for Braille symbols, it is important that a female die and a male die are disposed so as to match one another on the drive shafts. In the case of a polygonal shaft having an approximately square cross section, the tools can be pushed onto the drive shaft in four different positions. In order to ensure that the tools are pushed on in the correct position, the drive shafts each have at least one indexing pin 63 and the tool units have an indexing groove 62. This ensures that the tool units are pushed on in the correct position.

Figure 9B:
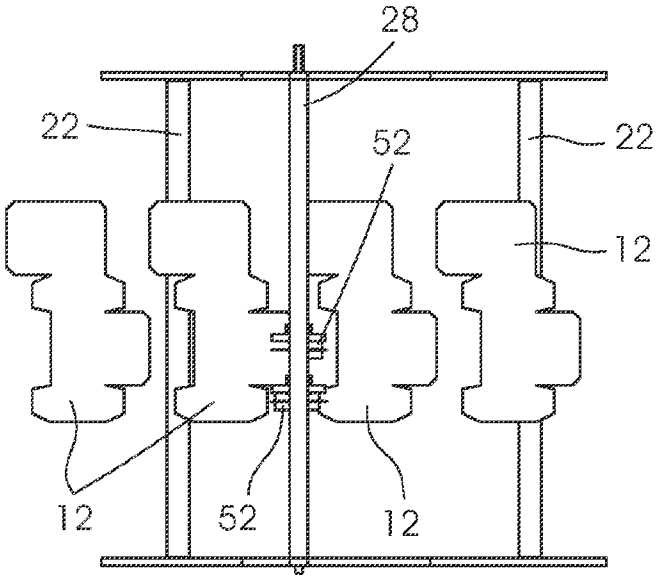
FIGS. 9A and 9B are perspective and plan views showing a device according to the invention with creasing tools.
Figure 9A:
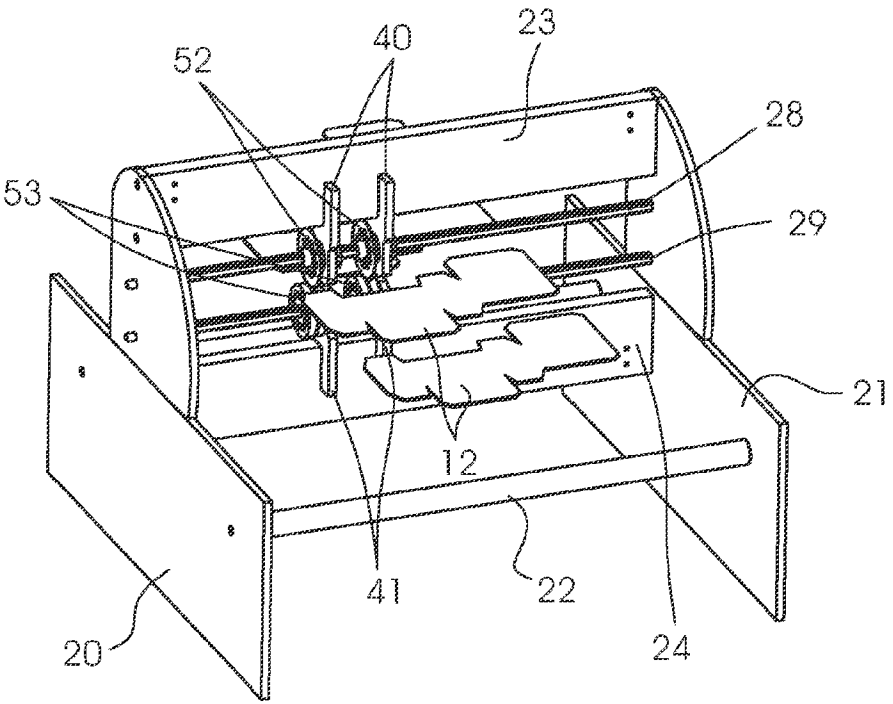

In FIGS. 9A and 9B, the device according to the invention is shown in an embodiment for synchronous creasing with creasing tools. Carton blanks 12 are transported through between two top creasing tools 52 and two bottom creasing tools 53 as shown. The top and bottom creasing tools 52, 53 are guided by the tool guide elements 40, 41, which are supported on the respective cross members 23, 24 in the manner already described. The two creasing tools 52, 53 are only shown by way of example, whereas any desired number of creasing tools can be disposed on the drive shafts according to requirements. A mixture of different tools, for example creasing tools together with embossing tools, is also possible.

In FIGS. 10A and 10B, the device according to the invention is shown in an embodiment for synchronous embossing as a "Braille module." The carton blanks 12 are transported through between four top Braille embossing tools as shown, which are constructed as female dies 54, and bottom Braille embossing tools, which are constructed as male dies 55. The female dies 54 and male dies 55 are guided by the tool guide elements 40, 41, which are supported on the respective cross members 23, 24 in the manner already described. As can be seen, the Braille tools 54, 55 can be set to any desired point of the carton blank. There can also be any desired number of Braille tools 54, 55.

The invention claimed is:

1. A device for holding tools for processing flat, sheet-shaped material in a sheet-processing machine, folding carton gluer, folding machine or cover feeder, the device comprising:

a right-hand frame wall and a left-hand frame wall;

cross members interconnecting said right-hand and left-hand frame walls;

universal holding cylinders;

bottom tool units and top tool units for processing a blank moving in a blank running direction, said tool units having at least one of a die cutting tool, an embossing tool, a cutting tool or a creasing tool, and at least one of said tool units having a respective top tool or bottom tool fastened to a respective one of said universal holding cylinders;

a bottom tool holding device for said bottom tool units and a top tool holding device for said top tool units, said tool holding devices each having respective right-hand and left-hand side walls, respective top and bottom cross members and respective top and a bottom drive shafts;

a plurality of said tool units being disposed on each respective one of said drive shafts, and each respective one of said tool units being configured to be positioned in a peripheral direction relative to others of said tool units;

servomotors configured to drive said top and bottom drive shafts;

said bottom cross member being fastened to said frame walls, said bottom drive shaft being fastened in said side walls of said bottom tool holding device, and said top cross member and said top drive shaft being fastened in said side walls of said top tool holding device;

said top cross member and said bottom cross member having a profile configured for absorbing forces produced during the processing of the blank by said top and bottom tool units transversely to, in and perpendicular to the blank running direction; and a bottom tool guide element and a top tool guide element being configured for sliding lateral adjustment of said top tool units and said bottom tool units on said cross members.

2. The device according to claim 1, wherein said top cross member has a rectangular construction and is fastened perpendicularly between said side walls of said top tool holding device, and said bottom cross member has a rectangular construction and is fastened perpendicularly between said frame walls.

3. The device according to claim 1, which further comprises pneumatic clamping elements for fixing said top tool units and said bottom tool units at any desired point on said drive shafts.

4. The device according to claim 1, wherein said side walls of said bottom tool holding device are fastened to said frame walls.

5. The device according to claim 4, wherein one of said side walls of said bottom tool holding device is disposed on an operator side and is constructed as a removable bearing cap for said bottom drive shaft.

6. The device according to claim 5, wherein one of said side walls of said bottom tool holding device is disposed on an operator side and is constructed as a removable bearing cap for said bottom drive shaft.

7. The device according to claim 1, wherein one of said side walls of said top tool holding device is disposed on an operator side and has a removable bearing cap for said top drive shaft.

8. The device according to claim 1, wherein said top and bottom drive shafts are constructed as polygonal shafts.

9. The device according to claim 1, which further comprises pneumatic clamping elements, said top tool guide element and said bottom tool guide element having stop regions for said pneumatic clamping elements.

10. The device according to claim 1, which further comprises a centering element with which said top tool units and said bottom tool units interact.

11. The device according to claim 1, wherein said tool units have an indexing groove and said drive shafts have an indexing pin.

12. The device according to claim 1, which further comprises two pneumatic cylinders for varying a distance between said top and bottom tool units.

13. The device according to claim 1, which further comprises a fine setting device for setting a distance between said top and bottom tool units.

14. The device according to claim 1, which further comprises safety configurations for protecting said drive shafts against contact.

15. The device according to claim 1, which further comprises protective boxes for protecting said tool units against contact.

16. A device for holding tools for processing flat, sheet-shaped material in a sheet-processing machine, folding carton gluer, folding machine or cover feeder, the device comprising:

a right-hand frame wall and a left-hand frame wall of a frame;

cross members interconnecting said right-hand and left-hand frame walls;

universal holding cylinders;

a bottom tool units and a top tool units, said tool units having at least one of a die cutting tool, an embossing tool, a cutting tool or a creasing tool, and at least one of said tool units having a respective top tool or bottom tool fastened to a respective one of said universal holding cylinders;

a bottom tool holding device for said bottom tool units and a top tool holding device for said top tool units, said tool holding devices each having respective right-hand and left-hand side walls, respective top and bottom cross members and respective top and a bottom drive shafts;

a plurality of said tool units being disposed on each respective one of said drive shafts, and each respective one of said tool units being configured to be positioned in a peripheral direction relative to others of said tool units;

servomotors configured to drive said top and bottom drive shafts;

said bottom cross member being fastened to said frame walls, said bottom drive shaft being fastened in said side walls of said bottom tool holding device, and said top cross member and said top drive shaft being fastened in said side walls of said top tool holding device;

a bottom tool guide element and a top tool guide element being configured for sliding lateral adjustment of said top tool units and said bottom tool units on said cross members; and an axis of rotation being fixed relative to said frame, said top tool holding device being pivotable about said axis of rotation.

17. The device according to claim 16, which further comprises pneumatic clamping elements for fixing said top tool units and said bottom tool units at any desired point on said drive shafts.

18. The device according to claim 16, wherein said side walls of said bottom tool holding device are fastened to said frame walls.

19. The device according to claim 16, wherein one of said side walls of said top tool holding device is disposed on an operator side and has a removable bearing cap for said top drive shaft.

20. The device according to claim 16, wherein said top and bottom drive shafts are constructed as polygonal shafts.

21. The device according to claim 16, which further comprises a centering element with which said top tool units and said bottom tool units interact.

22. The device according to claim 16, wherein said tool units have an indexing groove and said drive shafts have an indexing pin.

23. The device according to claim 16, which further comprises two pneumatic cylinders for varying a distance between said top and bottom tool units.

24. The device according to claim 16, which further comprises a fine setting device for setting a distance between said top and bottom tool units.

25. The device according to claim 16, which further comprises safety configurations for protecting said drive shafts against contact.

26. The device according to claim 16, which further comprises protective boxes for protecting said tool units against contact.

* * * * *